US008312998B2

(12) United States Patent
Theisen

(10) Patent No.: US 8,312,998 B2
(45) Date of Patent: Nov. 20, 2012

(54) DISPLAYING SHEET MERCHANDISE

(75) Inventor: Jennifer A. Theisen, Crystal, MN (US)

(73) Assignee: Target Brands, Inc., Minneapolis, MN (US)

( * ) Notice: Subject to any disclaimer, the term of this patent is extended or adjusted under 35 U.S.C. 154(b) by 179 days.

(21) Appl. No.: 12/355,477

(22) Filed: Jan. 16, 2009

(65) Prior Publication Data

US 2010/0181267 A1 Jul. 22, 2010

(51) Int. Cl.
*A47F 7/16* (2006.01)

(52) U.S. Cl. ..... 211/45; 211/128.1

(58) Field of Classification Search ..... 211/10, 211/41.14, 41.15, 41.16, 45, 46, 47, 48, 49.1, 211/50, 55, 57.1, 85.26, 85.31, 86.01, 87.01, 211/88.01, 90.03, 90.04, 106, 189, 190, 193, 211/194, 208, 207, 181.1, 183, 128.1
See application file for complete search history.

(56) References Cited

U.S. PATENT DOCUMENTS 2,140,116 A * 12/1938 Rubenstein et al. ..... 211/50
2,286,831 A 6/1942 Ressinger
D162,397 S 3/1951 Fink
D167,820 S 9/1952 Zel et al.
2,742,161 A * 4/1956 Nuttall ..... 211/11
D180,177 S 4/1957 Crisafi
2,793,760 A * 5/1957 Zel et al. ..... 211/55
D181,412 S 11/1957 Fox
2,879,899 A 3/1959 Shenkin
2,884,136 A * 4/1959 Leighton ..... 211/41.14
3,138,261 A * 6/1964 Witteborg ..... 211/41.1
3,176,848 A * 4/1965 Stefan ..... 211/40
3,190,242 A * 6/1965 Shelly ..... 108/60
3,227,503 A * 1/1966 Fletcher et al. ..... 312/234
D205,816 S 9/1966 Kleinman
3,385,451 A * 5/1968 Anderson ..... 211/60.1
3,394,973 A * 7/1968 Scott ..... 312/262
3,528,558 A 9/1970 Williams
3,534,863 A * 10/1970 Howard ..... 211/47
3,661,269 A * 5/1972 Scherzer ..... 211/50
3,777,896 A * 12/1973 Ehrlich ..... 211/59.2
3,889,813 A * 6/1975 Wright ..... 211/41.15
3,908,830 A 9/1975 Skrzelowski
D240,786 S 8/1976 Adams, Jr.
3,997,060 A 12/1976 Kunin
4,034,864 A * 7/1977 Tyson et al. ..... 211/50
D249,615 S 9/1978 Frisbey
D253,080 S 10/1979 Corrigan
4,197,950 A * 4/1980 Ovitz, III ..... 211/134
4,256,043 A * 3/1981 Ovitz, III ..... 108/29
4,299,327 A * 11/1981 Thauer ..... 211/186
4,342,268 A 8/1982 Grava
D272,399 S 1/1984 Kates
4,498,592 A 2/1985 Colucci (Continued)

*Primary Examiner* — Darnell Jayne
*Assistant Examiner* — Stanton L Krycinski
(74) *Attorney, Agent, or Firm* — Leanne Taveggia Farrell; Westman, Champlin & Kelly, P.A.

(57) ABSTRACT

Particular embodiments of a display fixture for displaying sheet products to consumers can include first and second frame members that are toollessly and removably mounted to a rear support frame, wherein the first frame member includes horizontal trays and the second frame member includes vertical bays. The display fixture may also include a first set of vertical bays that are arranged lateral of the horizontal trays and angled away from the horizontal trays at a first angle. The display fixture may further include a second set of vertical bays that are arranged lateral of the horizontal trays and angled away from the horizontal trays at a second angle that is different from the first angle.

11 Claims, 6 Drawing Sheets

U.S. PATENT DOCUMENTS

| | | | | | |
|---|---|---|---|---|---|
| D278,954 | S | * | 5/1985 | Bolyn | D6/409 |
| 4,604,061 | A | | 8/1986 | Willcocks et al. | |
| 4,678,086 | A | * | 7/1987 | Nervig et al. | 211/47 |
| D306,942 | S | | 4/1990 | Patke | |
| 5,029,715 | A | * | 7/1991 | Strada | 211/55 |
| 5,031,781 | A | | 7/1991 | Price et al. | |
| 5,111,943 | A | * | 5/1992 | Ramey | 211/59.4 |
| 5,292,010 | A | * | 3/1994 | Pickles et al. | 211/41.12 |
| 5,335,797 | A | * | 8/1994 | Myers | 211/50 |
| 5,346,076 | A | * | 9/1994 | Hart | 211/86.01 |
| 5,394,995 | A | * | 3/1995 | Lusk et al. | 211/59.2 |
| D367,372 | S | | 2/1996 | Eng et al. | |
| D368,181 | S | * | 3/1996 | Dabrowski | D6/409 |
| D372,816 | S | | 8/1996 | Rose et al. | |
| D392,820 | S | | 3/1998 | Shanahan et al. | |
| 5,836,459 | A | | 11/1998 | Nezwek et al. | |
| 6,006,926 | A | | 12/1999 | O'Reilly et al. | |
| 6,170,674 | B1 | | 1/2001 | Caterinacci | |
| D451,024 | S | | 11/2001 | Glauth et al. | |
| 6,484,890 | B1 | | 11/2002 | Miller | |
| D476,170 | S | * | 6/2003 | Johnson | D6/462 |
| 6,659,294 | B1 | * | 12/2003 | Simard | 211/181.1 |
| 6,935,514 | B2 | * | 8/2005 | Lackey et al. | 211/60.1 |
| D524,573 | S | * | 7/2006 | Robinson et al. | D6/463 |
| D622,977 | S | | 9/2010 | Wade et al. | |
| 2002/0008074 | A1 | | 1/2002 | Spencer | |
| 2006/0144805 | A1 | | 7/2006 | Wang | |
| 2006/0273056 | A1 | * | 12/2006 | Smits et al. | 211/189 |
| 2011/0204007 | A1 | | 8/2011 | Golden et al. | |

* cited by examiner

DISPLAYING SHEET MERCHANDISE

TECHNICAL FIELD

This disclosure relates to a display apparatus that retains generally planar products such as posters, posterboard, and foamcore products.

BACKGROUND

Display fixtures can be used in retail stores or other environments to present various products to consumers. For example, greeting cards, carpet samples, magazines, and other products may be displayed in trays or slots of a designated display fixture. Such a display fixture can be arranged along an aisle in a store so that consumers walking by the display fixture can grasp selected products.

Posters and prints have been displayed in stands that contain a number of posters or prints, each of which is mounted to a generally rigid backing. The display sits on the floor of a retail area and has two generally vertical walls. A number of posters or prints are retained between the walls in a generally vertical position. The distance between the walls is generally sufficient to permit the posters or prints to lean slightly to one side, which in turn improves the customers' view of the artwork on the face of the product. In order to view another poster or print, a customer moves one of the products, as by leaning it against the opposing wall of the display stand. The next print or poster is thereby exposed for viewing.

Posters have been also been displayed in fixtures that allow a customer to view various posters while standing in a stationary position. Such fixtures generally include a number of frames that are hinged at wall mount. Each frame hold one or more poster products in a vertical orientation. The customer can view one poster and then move a frame like turning a page of a book, thereby exposing one or more additional posters. This type of fixture may in certain implementations utilize less retail floor space than floor stands adapted to retain a similar number of poster products. However, the area below the frames is generally not utilized and the customer cannot view a significant number of the posters without articulating the frames.

Sheet products can also be presented to consumers using a display fixture consisting of a plurality of shelves. The sheet products can be placed in a generally horizontal orientation on the shelves, thereby exposing the end of the sheet product to the customers for viewing. Alternatively, planar sheet products have been displayed in a generally upright orientation facing the aisle or walkway along which customers pass. In such display fixtures substantially all of the front-facing display area is occupied. Especially for large sheet products, such an arrangement substantially reduces the number of products that can be displayed in a given retail space.

SUMMARY

Some embodiments of a display fixture can be used to present a variety of generally planar products to consumers. For example, the display fixture can include a set of horizontal trays that are downwardly angled from a rear portion so as to display a number of different sheet products (e.g., different colors of posterboard products) and a set of vertical slots that are angled transversely from a rear portion so as to display other sheet products (e.g., different sizes of foamcore sheet products). In some embodiments the display fixture may include a front-facing area to receive related merchandise (e.g., adhesive products, writing utensils) adjacent to the sheet products. As such, the display fixture can be used to expose a number of different sheet products to a consumer in a relatively confined retail space while also displaying related products to facilitate cross-merchandising. Moreover, some embodiments of the display fixture can feature a two-piece construction that enables retail employees to readily assemble the display unit by hanging each of the two pieces to adjacent sections of a bracket system.

Particular embodiments of a display fixture for displaying sheet products to consumers can include horizontal trays that are downwardly angled from rear to front. The horizontal trays may releasably retain posterboard sheet products so that at least a major surface of one posterboard sheet product in each horizontal tray is viewable from a front of the display fixture. The display fixture may also include a first set of vertical slots that are arranged lateral of the horizontal trays and angled away from the horizontal trays at a first angle. The first set of vertical slots may releasably retain foamcore sheet products so that at least a major surface of one foamcore sheet product in each vertical slot is viewable from the front of the display fixture. The display fixture may further include a second set of vertical slots that are arranged lateral of the horizontal trays and angled away from the horizontal trays at a second angle that is different from the first angle. The second set of vertical slots may releasably retain foamcore sheet products so that at least a major surface of one foamcore sheet product in each vertical slot is viewable from the front of the display fixture.

Some embodiments include a method of displaying sheet products in a display fixture. The method may include removably mounting a first frame component of a display fixture to a rear support wall. The first frame component may define horizontal trays that are downwardly angled from rear to front. The method may also include releasably retaining posterboard sheet products in the horizontal trays so that at least a major surface of one posterboard sheet product in each horizontal tray is viewable from a front of the display fixture. The method may further include removably mounting a second frame component of the display fixture to the rear support wall in a position adjacent to the first frame component. The second frame component may define vertical slots that are arranged lateral of the horizontal trays and angled away from the horizontal trays. The method may also include releasably retaining foamcore sheet products in the vertical slots so that at least a major surface of one foamcore sheet product in each vertical slot is viewable from the front of the display fixture. The display fixture may comprise a two-piece assembly defined by the first and second frame components that are removably and mounted to the rear supporting structure such the fixture can be hung and removed without the use of tools.

In other embodiments, a display fixture for displaying sheet products to consumers may include horizontal trays that are downwardly angled from rear to front. The horizontal trays may releasably retain posterboard sheet products so that at least a major surface of one posterboard sheet product in each horizontal tray is viewable from a front of the display fixture. The display fixture may also include vertical slots that are arranged lateral of the horizontal trays and angled away from the horizontal trays. The vertical slots may releasably retain foamcore sheet products so that at least a major surface of one foamcore sheet product in each vertical slot is viewable from the front of the display fixture. The display fixture may further include a front-facing wall portion to display one or more related products usable with the posterboard sheet products or foamcore sheet products. The front-facing wall portion may be arranged between at least one horizontal tray and at least one vertical slot.

In some embodiments, a product display system may include a rear support structure to receive a display fixture comprising trays and vertical dividers. The system may also include five or more trays projected forwardly from the rear support structure and projecting downwardly an angle of about 45° to about 70°. The system may further include three or more first vertical dividers projecting forwardly from the rear support structure and projecting laterally away from the trays at a first lateral angle of about 35° to about 60° from the rear support structure. The system may also include three or more second vertical dividers projecting forwardly from the rear support structure and projecting laterally away from the trays at a second lateral angle of about 45° to about 75° from the rear support structure. The first lateral angle may different from the second lateral angle.

These and other embodiments described herein may provide one or more of the following benefits. First, some embodiments of the display fixture can include a set of angled trays to display a variety of different posterboard products and a set of angled vertical slots to display different sizes of foamcore sheet products. The angled presentation of the sheet products in the trays and the slots can allow for a variety of sheet products to be displayed to a consumer in a compact manner while also increasing the amount of product surface area visible in a consumer's line of sight. Such a compact configuration can be useful for conserving space in a retail environment. Second, the display fixture may also include a front-facing area to receive adhesive products, writing utensils, or other related merchandise so that this merchandise is contemporaneously presented to consumers adjacent to the sheet products. Third, some embodiments of the display fixture can be readily assembled using two frame components that mount to a rear support structure. In such circumstances, a store worker in a first store can readily assemble the entire display fixture in a manner that is consistent with other store workers in other stores, thereby providing a consistent presentation of the sheet products from store to stores The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
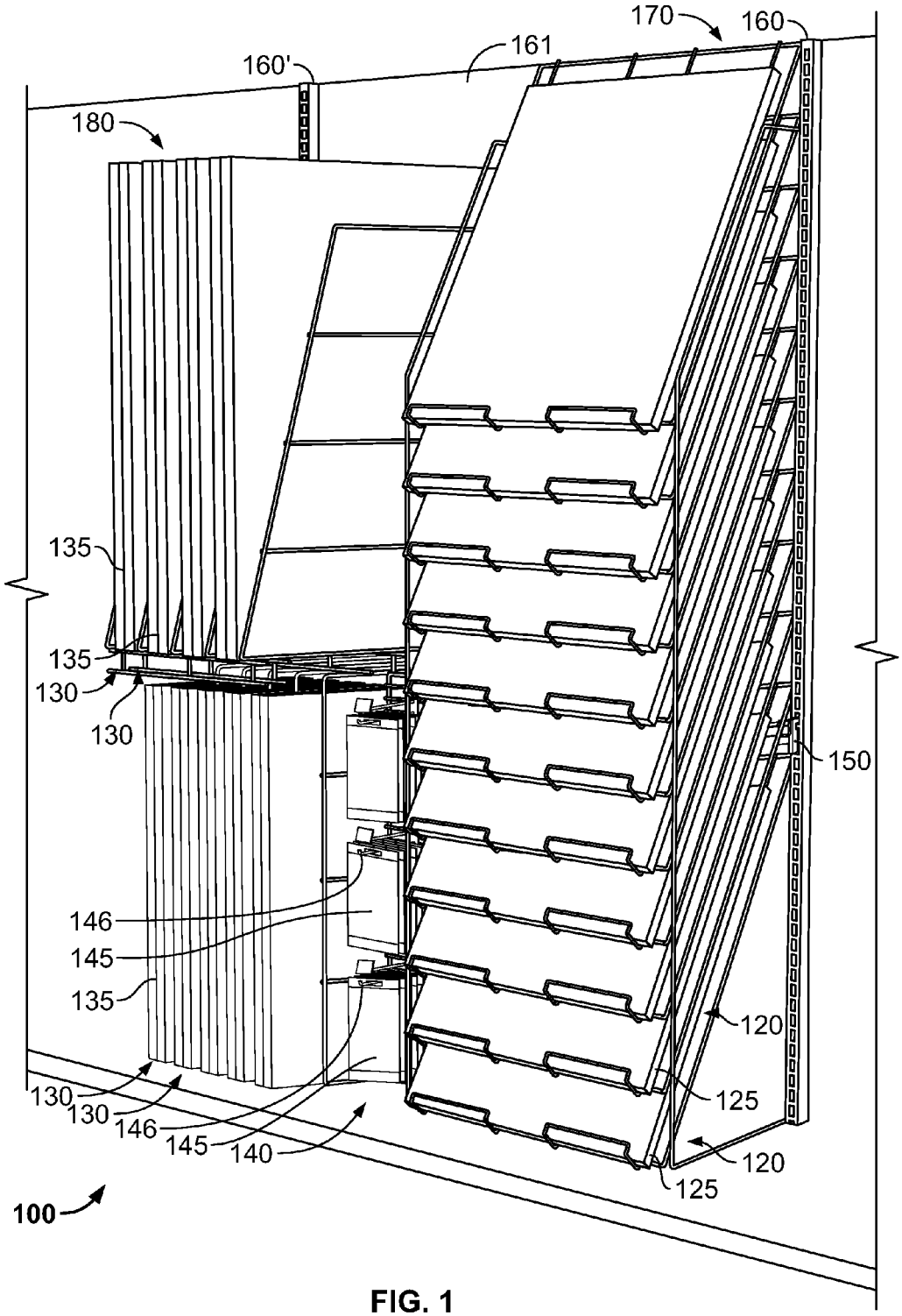
FIG. 1 is a perspective view of a display fixture, in accordance with some embodiments.

Referring to FIG. 1, some embodiments of a display fixture 100 can be configured to retain a variety of sheet products in a manner that presents the sheet products to consumers. For example, the display fixture 100 can releasably retain a first type of sheet products, such as posterboard products 125, in a set of horizontal trays 120 (i.e., shelves) that are downwardly angled from rear to front. Also in this example, the display fixture 100 can releasably retain a second type of sheet products, such as foamcore sheet products 135, in a set of vertical slots 130 (i.e., dividers) that are transversely angled away from the horizontal trays 120. In the illustrated example, the display fixture 100 can also display one or more related products 145 (e.g., adhesives, writing instruments, stencils) usable with the sheet products 125, 135, or both, on a front-facing wall portion 140. Such a configuration permits a retailer to cross-merchandise these related products 145 while a consumer is viewing the available sheet products 125 and 135. The display fixture 100 can, for example, include a mounting bracket 150 allowing the fixture 100 to be removably mounted to a rear support structure 160, 160' (e.g., a wall or gondola fixture). In some embodiments, the display fixture 100 can be a wire-frame fixture. In alternative embodiments, the display fixture 100 can be at least partially constructed from one or more panels.

The display fixture 100 can advantageously present products to consumers, such as retail consumers viewing products in a store aisle. The set of horizontal trays 120 can retain and display sheet products 125 (such as posterboard products) so that at least a major surface of one sheet 125 in each tray 120 is viewable from the front of the display fixture 100. Thus, in the depicted embodiment, the set of horizontal trays 120 can display a major surface of eleven posterboard products 125 (e.g., eleven different colors of posterboard products 125). The set of vertical slots 130 can retain and display sheet products 135 (such as foamcore sheet products) so that at least a major surface of one sheet 135 in each slot is viewable from the front of the display fixture 100. One or more sheets can be retained and presented in each of the trays 120 and slots 130. An angled presentation of products in the trays 120 and the slots 130 can allow for a variety of products to be displayed to a consumer in a compact manner. For example, as compared to a perpendicular orientation relative to a rear support structure (e.g., extending normal from a rear support wall), the angled presentation in this embodiment can increase the amount of product surface area visible in a consumer's line of sight while decreasing the depth between the forward and rearward portions of the display fixture 100. Such a compact configuration can be useful for conserving space in a retail environment, for example.

Sheet products 125 and 135 presented in the trays 120 and the slots 130 can include sheets of varying properties (e.g., color, size, thickness, material, surface), and products can be grouped or organized by one or more of these properties. Also, a product orientation (e.g., vertical or horizontal) can, for example, be selected based on one or more product properties. For example, stiff or self-supporting sheets (e.g., the foamcore sheet products 135 or the like) can be retained in a vertical position in the slots 130. In some circumstances, the foamcore sheet products 130 can have a thickness of about ⅛ inch to about ½-inch, thereby providing a self-support sheet product that can stand upright in the vertical slot 130. The horizontal trays 120 can be useful for retaining flexible sheet products (e.g., posterboard sheet products 125 or the like) that rest on a tray support. For example, some posterboard products 125 may have a thickness of about 8-ply to about 14-ply, which is generally more flexible than the thicker foamcore sheet products. As such, the posterboard products 125 can be presented in the trays 120 so that a variety of posterboard colors are displayed to the consumers. (It should be understood that the thicknesses of the sheet products 125 and 135 is not to scale in FIG. 1 and is exaggerated for purposes of illustration.)

Still referring to FIG. 1, cross-merchandising can, in some instances, increase product sales by contemporaneously displaying related products to a consumer, increasing the likelihood that related products are purchased together. The display fixture 100 can enhance cross-merchandising by allowing for a display of products 145 related to sheet products 125 and 135 presented in the trays 120 and the slots 130 at the front-facing wall portion 140. For example, as previously described, the display fixture 100 can facilitate cross-merchandising by receiving one or more hooks 146 attached to the front-facing wall portion 140 to contemporaneously display related products 145 with the sheet products 125 and 135. Such products 145 can include, but are not limited to adhesives (e.g., glue, tape), writing instruments (e.g., pencils, pens, markers, crayons), stencils, cutting instruments (e.g., scissors, knives, hole punches), and decorative material (e.g., stickers, paint, fabric, string, glitter). In some embodiments, the front-facing wall portion 140 can be arranged between at least one tray 120 and at least one slot 130.

The exemplary display fixture 100 is a two-piece assembly defined by first frame components 170 and 180 that are removably coupled to a rear supporting structure (e.g., a wall or gondola fixture.) The first frame components 170 and 180 are removably mounted to the mounting bracket 150 that extends horizontally between support columns 160 and 160' of the rear wall 161. The set of horizontal trays 120 and the set of vertical slots 130 can each be included in separate frame components. The frame components can be transported separately, and later joined at a display site by a device such as the mounting bracket 150. Such a configuration can enable a store worker or other user to readily transport and setup the display fixture 100. For example, the user can lift the first first frame component 170 onto the rear mounting bracket 150 and lift the second first frame component 180 onto the rear mounting bracket 150 in a position adjacent to the first first frame component 170. Accordingly, the display fixture 100 can be readily assembled by a user.

Figure 4:
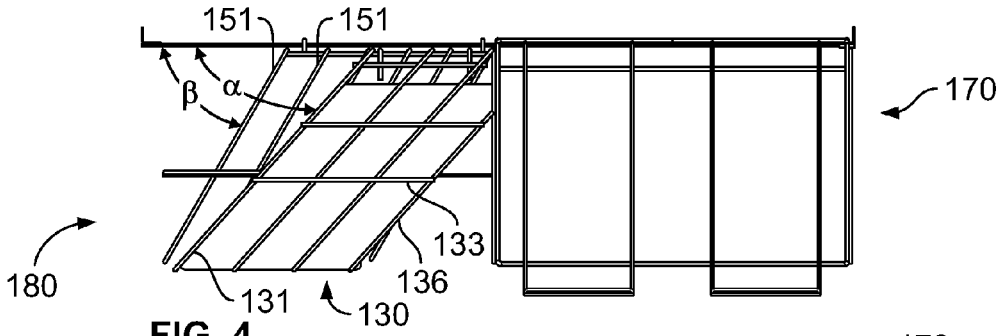
FIG. 4 is a top view of the display fixture of FIG. 2.
Figure 5:
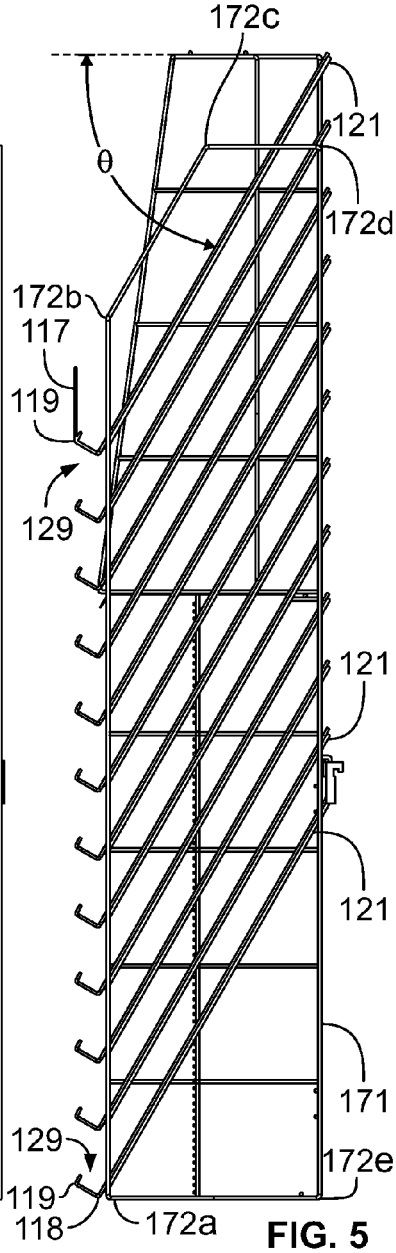
FIG. 5 is a side view of the display fixture of FIG. 2.

Referring now to FIGS. 2-5, the display fixture 100 includes a first frame component 170 a number of horizontal trays 120. The first frame component 170 includes frame members 171, 171' defining opposite and parallel sides of the first frame component 170. The frame members 171, 171' can be constructed from a wire material defining a perimeter of a polygon. In other embodiments, the frame members 171, 171' can be at least in part constructed of a generally planar rigid material such as molded plastic or acrylic. As shown in FIG. 5, the perimeter of the wire frame member 171 can be a five-sided shape defined by angled points 172*a-e*. Referring again to FIG. 2, the frame members 171, 171' can be connected by a lower bar 174 situated and attached at the bottom rearward segment of each frame member 171, 171'.

Figure 2:
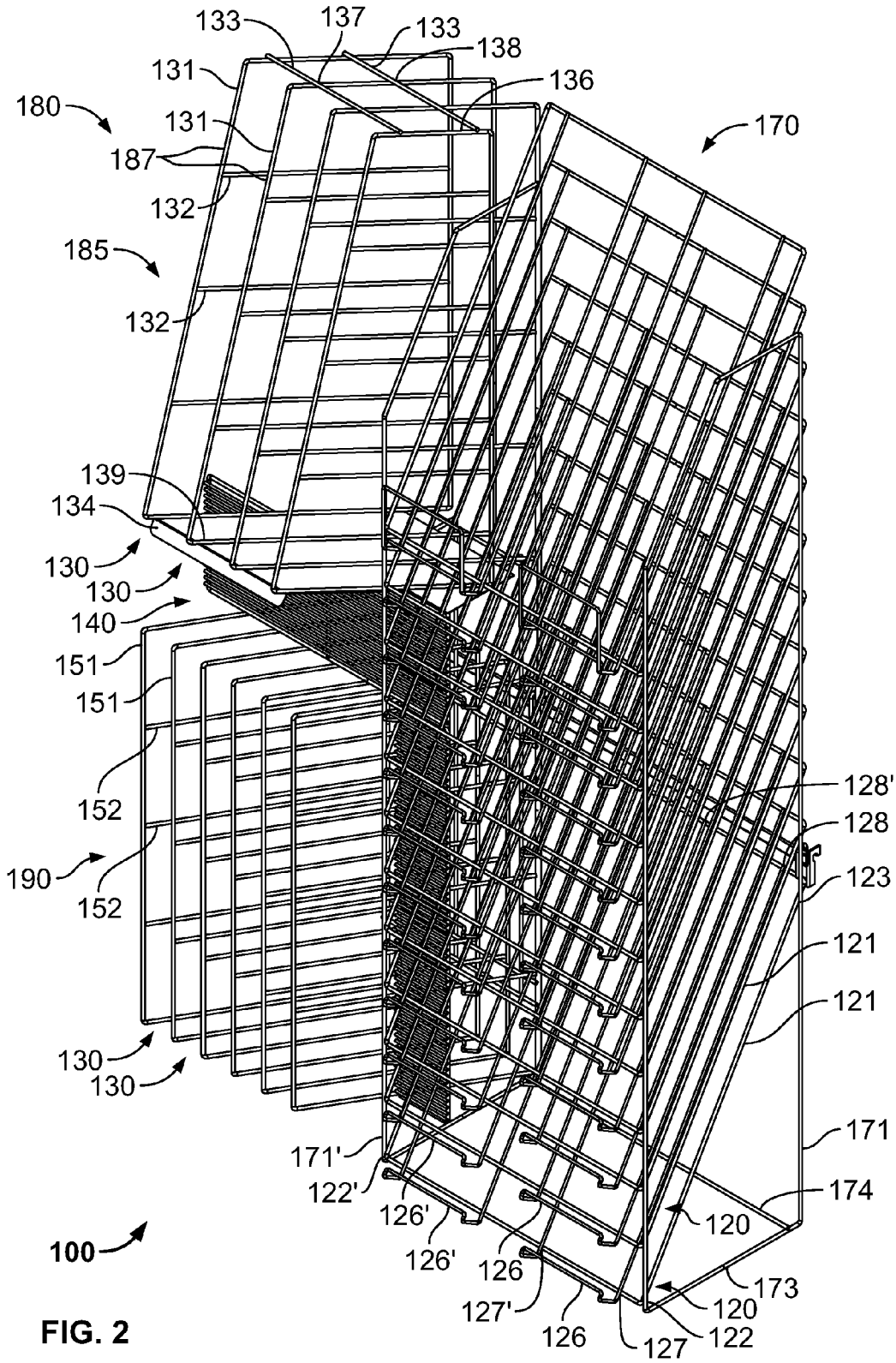
FIG. 2 is a perspective view of a display fixture, in accordance with some embodiments.

Each of the horizontal trays 120 includes a tray frame 121 coupled between the frame members 171, 171' of the first frame component 170 at a frontward point 122 and at a rearward point 123. For example, the trays 120 can be fixedly coupled to the side frame members 171, 171' so that the first frame component 170 is a generally rigid structure that is readily movable by a store worker or the other user. As such, a store worker can collectively mount the trays 120 in a selected position. As shown in FIGS. 2 and 5, the tray frames 121 comprise a wire frame construction and may have a generally rectangular perimeter. Each of the tray frames may be downwardly angled from rear to front. For example, the tray frames 121 can extend at a downward angle from the rear to the front of the first frame component 170. As shown in FIG. 5, a downward angle θ can be about 45° to about 70°, about 50° to about 65°, and about 55° to about 60° in this embodiment. In alternate embodiments, the downward angle θ can be lesser or greater, depending on material properties including size, flexibility, and coefficient of friction of the products to be displayed or depending on a desired compactness of the display fixture 100.

Referring to FIG. 2, each of the horizontal trays 120 includes at least one product retainer 126 coupled to the tray frame 121. For example, each of the horizontal trays 120 in this embodiment includes product retainers 126 and 126'. Each of the product retainers 126 and 126' in this embodiment can be coupled to the tray frame 121 at forward points 127 and 127' and at rearward points 128 and 128'.

As shown in FIGS. 2-5, the product retainers 126, 126' in this embodiment define a retaining space 129. In this embodiment, the retaining space 129 can releasably retain products such as the posterboard sheet products 125 (FIG. 1), by providing a resting surface for the posterboard sheet products 125 within the right-angle bends 118 and 119. The uppermost retaining space 129 in this embodiment can have attached at right-angle bends 119 an upwardly projecting element 117, relatively perpendicular to the front of the first frame component 170. The upwardly projecting element 117 can, for example, be used to house signage related to products stored within the horizontal trays 120.

Referring to FIG. 2, in this embodiment, twelve horizontal trays 120 are included in the first frame component 170. In alternate embodiments, the first frame components can include two to twenty-four trays 120, eight to sixteen trays 120, or ten to fourteen trays 120. In this embodiment, the horizontal trays 120 are uniformly spaced along the first frame component 170. In alternate embodiments, the horizontal trays 120 can be variably spaced along the first frame component 170. For example, the first frame component 170 including ten horizontal trays 120 can have a greater spacing between the tray frames 121 positioned nearer the bottom of the first frame component 170 and a lesser spacing between the tray frames 121 positioned nearer the top of the first frame component 170.

In some alternative embodiments, one or more of the tray frames 121 can be removable from the first frame component 170. For example, referring to FIG. 2, one or more tray frames 121 can be removably attached to the first frame component 170 at frontward points 122, 122' and at rearward points 123 (123' not shown). Removable attachment at points 122, 123 along the frame member 171 can be accomplished by providing hardware (e.g., a clamping mechanism, a pin and socket connector, or the like) at points 122, 123 for attaching the tray frame 121 to and detaching the tray frame 121 from the frame member 171. Removability can be facilitated by providing a groove along the frame member 171 along which the tray frame 121 can slide, preferably toward the front of the first frame component 170, but alternately toward the back. Removable tray frames 121 can enable a user to modify and reconfigure spacing of the horizontal trays 120.

Still referring to FIGS. 2-5, the display fixture 100 includes second frame component 180 having a number of vertical slots 130 to retain sheet products, such as foamcore sheet products 135 (FIG. 1). The second frame component 180 may include one or more front-facing wall portions 140 so as to receive related merchandise. The first frame component 180 includes an upper section 185 having an upper set of vertical slots 130, the front-facing wall portion 140, and a lower section 190 having a lower set of vertical slots 130 that are different from the upper set. The vertical slots 130 and the front-facing wall portion 140 are fixedly coupled together so that the second frame component 180 is a generally rigid structure that is readily movable by a store worker. As such, a store worker can collectively mount the trays 120 in a selected position.

Each of the vertical slots 130 in the upper section 185 is defined by a pair of vertical slot frames 131 coupled to the first frame component 180, arranged lateral of the horizontal trays 120 and angled away from the horizontal trays 120. Each of the vertical slot members 131 includes a front segment 187 oriented from rear to front at a downward angle. The downward angle of front segment 187 of each vertical slot member 131 is greater than the downward angle of the horizontal trays 120. The vertical slot frames 131 can be constructed from a wire material defining a perimeter of a trapezoid or other suitable shape. In some embodiments, the vertical slot frames 131 can be at least in part constructed of a generally planar materials such as molded plastic or acrylic. The vertical slot frames 131 can include one or more horizontally-aligned reinforcing elements 132 attached to the frontward and rearward edges of the vertical slot frames 131. The reinforcing elements 132 can provide structural stability to each of the vertical slot frames 131, and can provide lateral support for products (e.g., foamcore sheet products 135) releasably retained and displayed in the vertical slots 130 defined by the vertical slot frames 131.

The vertical slot frames 131 can be connected by one or more bar elements 133 extending horizontally across a top portion of each of the frames 131. The bar element 133 can be fixedly coupled to each of the frames 131. The vertical slot frames 131 can also be attached by a plate 134 extending horizontally across a bottom portion of each of the frames 131, the plate 134 being attached to each of the frames 131. In this embodiment, the plate 134 can provide bottom support for products (e.g., foamcore sheet products 135) releasably retained and displayed in the vertical slots 130. In some embodiments, the plate 134 can include a downwardly-projecting lip at a front edge of the plate 134 to guide products (e.g., foamcore sheet products 135) into and out of vertical slots 130 or to house signage related to products stored within the vertical slots 130.

Figure 3:
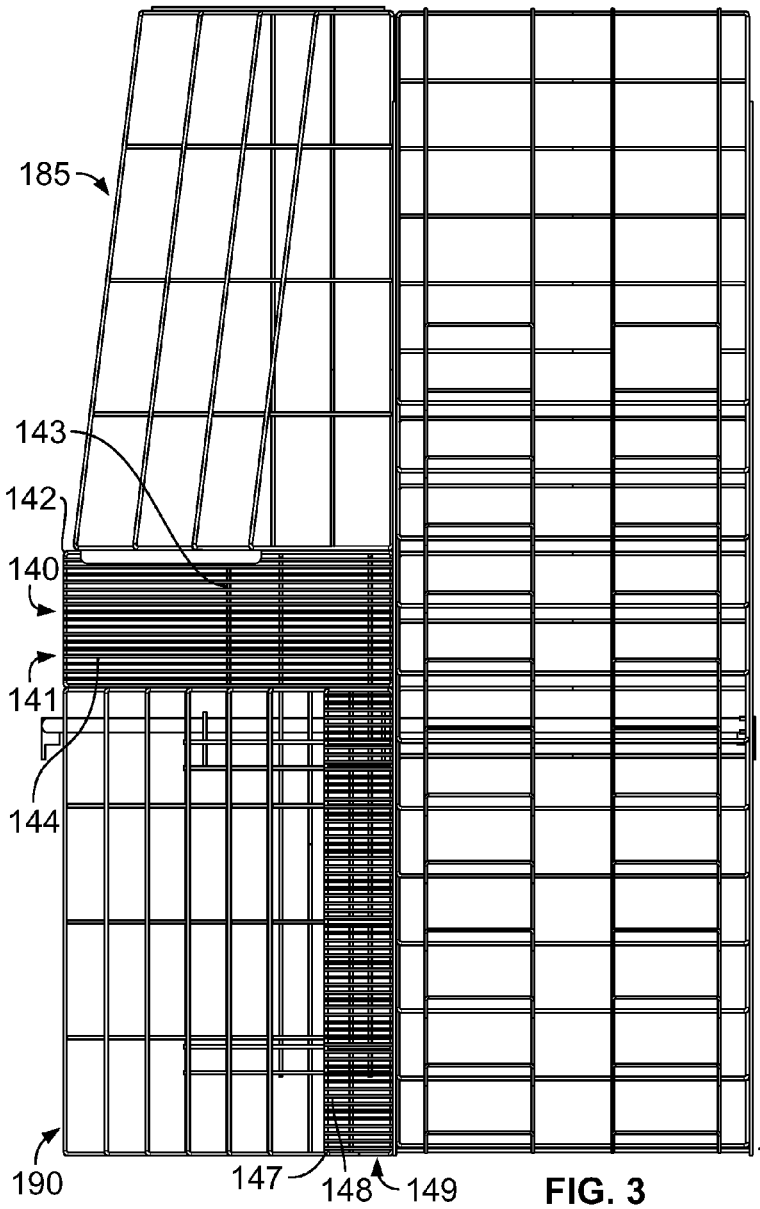
FIG. 3 is a front view of the display fixture of FIG. 2.

Referring to FIGS. 2-4, the vertical slots 130 can project forwardly from a rear plane of the fixture 100 and at a lateral angle (non-perpendicular) from the rear plane of the fixture 100. For example, the vertical slots 130 can angle away from the first frame component 170. As shown in FIG. 4, an angle $\alpha$ from the rear plane of the fixture 100 to the slots 130 in the upper section 185 can be about 35° to about 60°, about 40° to about 55°, and about 45° to about 50° in this embodiment. In alternate embodiments, the angle $\alpha$ can be lesser or greater, depending on material properties (e.g., size, flexibility, surface friction, etc.) of products to be displayed or depending on a desired compactness of the display fixture 100.

The second frame component 180 preferably includes three or more vertical slots 130 included in the upper section 185. For example, as shown in FIGS. 3-4, the upper section 185 includes three slots 130. In another example, as shown in FIG. 1, the upper section 186 includes four slots 130. In alternate embodiments, the upper section 185 of the second frame component 180 can include two to ten slots 130, two to seven slots 130, or three to five slots 130, depending upon the selected angle $\alpha$ and the width of each slot. In this embodiment, the vertical slots 130 are uniformly spaced along the upper section 185. In alternate embodiments, the vertical slots 130 can be variably spaced along the upper section 185. For example, the upper section 185 including five vertical slots 130 can have a greater spacing between the vertical slot frames 131 positioned nearer the first frame component 170 and a lesser spacing between the vertical slot frames 131 positioned farther from the first frame component 170.

In some alternative embodiments, one or more of the vertical slot frames 131 can be removable from the upper section 185. For example, referring to FIG. 2, one or more vertical slot frames 131 can be removably attached to the upper section 185 at upper points 137 and 138 and at lower contact line 139. Removable attachment at points 137 and 138 along the wire or bar elements 133 can be accomplished by providing hardware (e.g., a clamping mechanism, a pin and socket connector, or the like) at points 137, 138 for attaching the vertical slot frame 131 to and detaching the vertical slot frame 131 from the upper section 185. A groove can be provided in the plate 134 at the contact line 139 between the vertical slot frame 131 and the plate 134 to enable the frame 131 to slide along the plate 134, preferably toward the front of the upper section 185, but alternately toward the back. Removable vertical slot frames 131 can enable a user to modify and reconfigure spacing of the vertical slots 130 in the upper section 185.

Referring to FIGS. 2-3, some embodiments of the display fixture 100 include the front-facing wall portion 140 to receive related merchandise usable with the sheet products 125 and 135. For example, the front-facing wall portion 140 may include a horizontally-oriented front-facing wall portion 141 and a vertically-oriented front-facing wall portion 149. In the depicted embodiment, the horizontally-oriented front-facing wall portion 141 includes a wall frame 142. The wall frame 142 can be constructed from a wire material defining a horizontally-oriented rectangle or other suitable shape. In some embodiments, the wall frame 142 can be at least in part constructed of a flat panel material (e.g., sheet metal, plastic, etc.). In the depicted embodiment, the wall frame 142 can include one or more vertically-aligned reinforcing elements 143 attached to the top and bottom edges of the frame 142 and can provide structural stability to the frame 142. One or more horizontally-oriented wires or bars 144 can be attached to the side edges of the frame 142 and at one or more points along the reinforcing elements 143. In some embodiments, the horizontally-oriented wires or bars 144 can provide support for one or more product hooks 146 the receive the related products 145 (FIG. 1). In the depicted embodiment (FIG. 3), the vertically-oriented front-facing wall portion 149 includes a wall frame 147. The wall frame 147 can be constructed from a wire material defining a vertically-oriented rectangle or other suitable shape. In some embodiments, the wall frame 147 can be at least in part constructed of a flat panel material (e.g., sheet metal, plastic, etc.). In the depicted embodiment, the wall frame 147 can include one or more horizontally-oriented wires or bars 148 attached to the side edges of the frame 147. In some embodiments, the horizontally-oriented wires or bars 148 can provide support for one or more hooks 146 used for displaying related products 145 (FIG. 1).

As shown in FIGS. 2 and 3, the horizontally-oriented front-facing wall portion 141 in the depicted embodiment is arranged at least partially between the upper section 185 and the lower section 190 of vertical slots 130. The horizontally-oriented front-facing wall portion 141 can be attached to the upper section 185, for example, by a connection between the top edge of the wall frame 142 and the bottom face of the plate 134. In the depicted embodiment, the vertically-oriented front-facing wall portion 149 is arranged at least partially between the lower section 190 (of the second frame component 180) and the first frame component 170. The vertically-oriented front-facing wall portion 149 can be coupled to the horizontally-oriented front-facing wall portion 141, for example, by a connection between the top edge of the wall frame 147 and the bottom edge of the wall frame 142. In some embodiments, the upper section 185 and the lower section 190 can be connected, for example, by one or more supporting structures, as described in connection with FIG. 6.

Referring again to FIGS. 2-4, each of the vertical slots 130 in the lower section 190 may be defined by a pair of vertical slot frames 151, arranged lateral of the horizontal trays 120 and angled away from the horizontal trays 120. The vertical slot frames 151 can be constructed from a wire material defining a perimeter of a rectangle or other suitable shape. In some embodiments, the vertical slot frames 151 can be at least in part constructed of a generally planar material such as molded plastic or acrylic. The vertical slot frames 151 can include one or more horizontally-aligned reinforcing elements 152 attached to the frontward and rearward edges of the vertical slot frames 151. The reinforcing elements 152 can provide structural stability to each of the vertical slot frames 151, and can provide lateral support for products (e.g., foamcore sheet products 135) releasably retained and displayed in the vertical slots 130 defined by the vertical slot frames 151. The vertical slot frames 151 can be connected by one or more wire or bar elements 153 (as illustrated, for example, in FIG. 6) extending horizontally across a rear portion of each of the frames 151, the wire or bar element 153 being attached to each of the frames 151. In this embodiment, bottom support for products (e.g., foamcore sheet products 135) can be provided by a deck surface situated underneath the lower section 190.

As illustrated in FIGS. 2-4, the vertical slots 130 in the lower section 190 can project at a lateral angle (non-perpendicular) that is different from the vertical slots in the upper section 185. The different projection angles of the upper and lower slots 130 may permit sheet products of different sizes to be retained in the fixture without hanging over into the aisle. As shown in FIG. 4, an angle $\beta$ from the rear plane of the fixture 100 to the slots 130 in the lower section 190 can be about 45° to about 75°, about 50° to about 70°, and about 55°-65° in this embodiment. In alternate embodiments, the angle $\beta$ can be lesser or greater, depending on material properties including the size, flexibility, and coefficient of friction of the products to be displayed or depending on a desired compactness of the display fixture 100. In the embodiment depicted in FIG. 4, the angle $\beta$ is greater than $\alpha$. As such, the slots 130 in the lower section 190 can be used to display foamcore sheet products having a greater size than the foamcore sheet products in the upper slots 130 of the upper section 185. In alternative embodiments, the angle $\alpha$ can be greater than the angle $\beta$, or the angles $\alpha$ and $\beta$ can be substantially equal.

The second frame component 180 can include five vertical slots 130 in the lower section 190. In some embodiments, the lower section 190 of the second frame component 180 can include two to twelve slots 130, three to ten slots 130, or four to seven slots 130, depending upon the selected angle $\beta$ and the widths of the slots 130. In this embodiment, the vertical slots 130 are uniformly spaced along the lower section 190. In alternate embodiments, the vertical slots 130 can be variably spaced along the lower section 190. For example, the lower section 190 including seven vertical slots 130 can have a greater spacing between the vertical slot frames 151 positioned nearer the first frame component 170 and a lesser spacing between the vertical slot frames 151 positioned farther from the first frame component 170.

Figure 6:
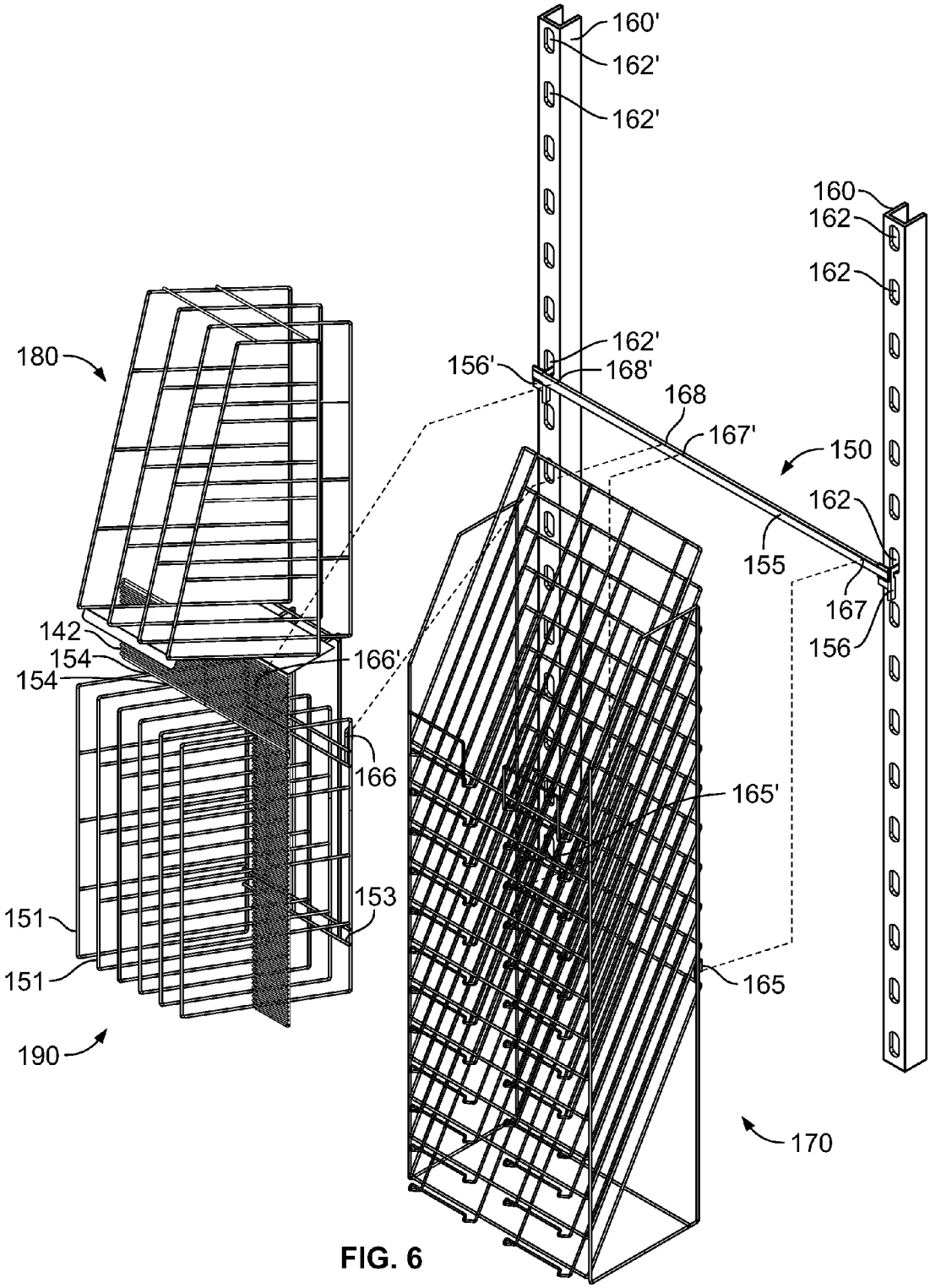
FIG. 6 is a perspective exploded view of a display fixture and a rear support structure.
Figure 7:
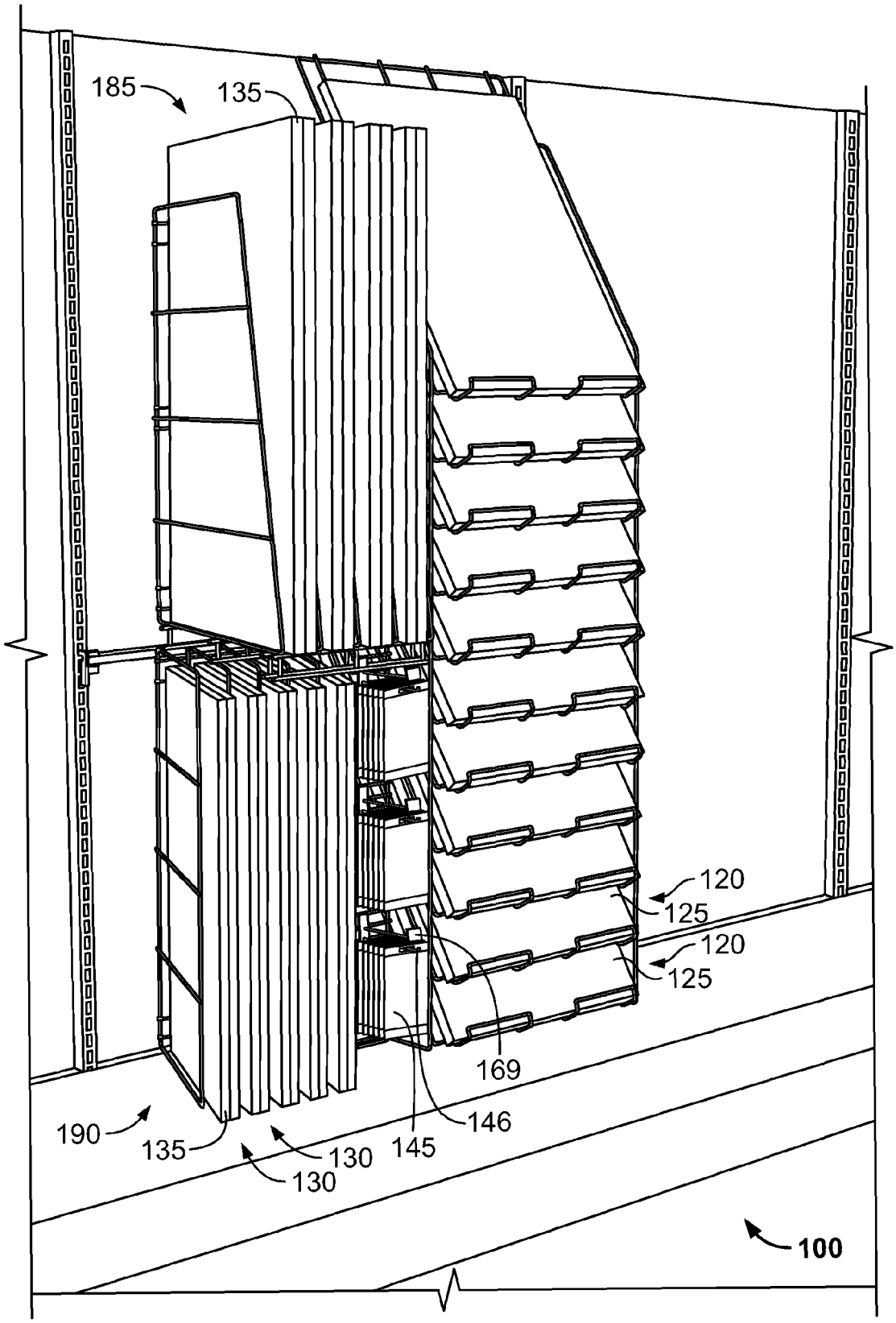
FIG. 7 is a perspective view of a display fixture that retains different types of sheet products, in accordance with some embodiments.
Figure 9:
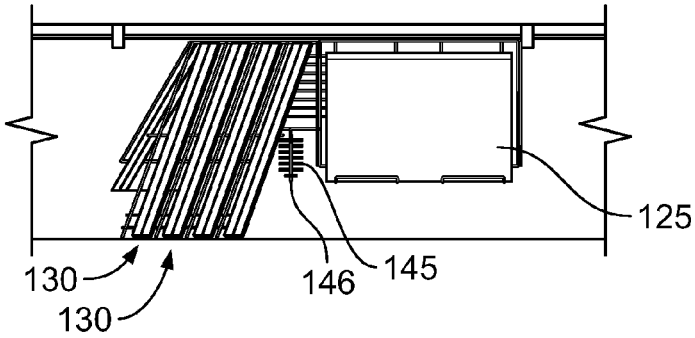
FIG. 9 is a top view of the display fixture of FIG. 7.
Figure 8:
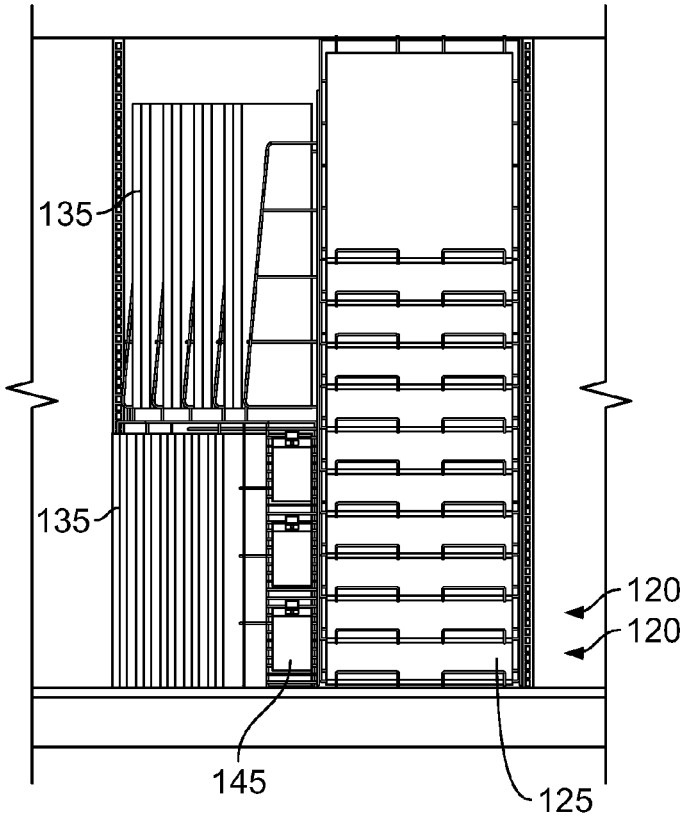
FIG. 8 is a front view of the display fixture of FIG. 7.
Figure 10:
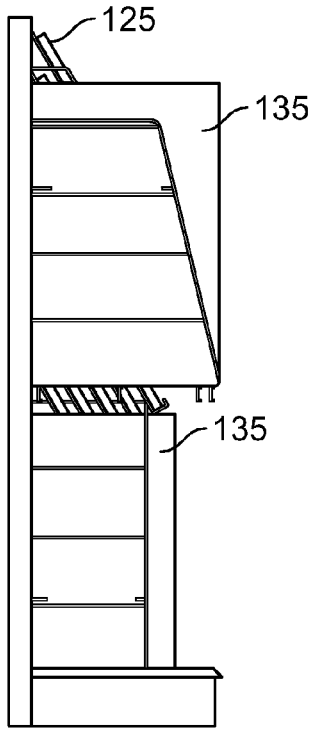
FIG. 10 is a side view of the display fixture of FIG. 7.

In some alternative embodiments, the angle $\beta$ (FIG. 4) of the vertical slots frames 151 of the lower section 190 can be adjustable. Referring to FIG. 6, for example, each of the points 154 can include a rotatable joint enabling a user to pivot the set of vertical slot frames 151 about a vertical axis extending downward from the points 154. In these adjustable embodiments, for example, the wire or bar element 153 can be connected to the rearward edges of each of the vertical slot frames 151 by an adjustable mechanism (e.g., a hinge connector) enabling a change to angle $\beta$ while maintaining relative spacing between the vertical slot frames 151.

In some alternative embodiments, one or more of the vertical slot frames 151 can be removable from the lower section 190. For example, one or more vertical slot frames 151 can be removably attached to the wall frame 142. Removable attachment along the wall frame 142 can be accomplished by providing hardware (e.g., a clamping mechanism, a pin and socket connector, etc.) at point 154 for attaching the vertical slot frame 151 to and detaching the vertical slot frame 151 from the lower section 190. A groove can be provided at points at the wire or bar elements 153 to guide the rearward section of the vertical slot frame 151 into a set position. Removable vertical slot frames 151 can enable a user to modify and reconfigure spacing of the vertical slots 130 in the lower section 190.

Referring now to FIG. 6, some embodiments of the display fixture 100 can be readily assembled by a user in a store environment. For example, some embodiments of the display fixture 100 can be assembled by coupling the first and second frame components 170 and 180 to a rear support structure. In such circumstances, the in-store assembly can be consistently performed without complex instruction or a large number of assembly components. Accordingly, the display fixture 100 can be assembled in a consistent manner from store to store, thereby providing a consistent presentation of the sheet products from store to store.

In some embodiments, a rear support structure (such as a wall, support columns, a combination thereof, or the like) can receive a mounting bracket 150. As shown in FIG. 6, each frame components 170, 180 can be readily lifted and connected to the mounting bracket 150 so that the first and second frame components 170 and 180 to the rear support structure. In this embodiment, the rear support structure includes at least two vertical columns 160, 160' that are fixed mounted to rear wall 161 (refer also to FIG. 1). The rear support structure can, for example, be a gondola wall fixture with base platforms and a vertical wall. The rear support structure can include a series of mounting holes 162, 162' spaced uniformly along the frontward face of the structure.

The mounting bracket 150 includes a mounting bar 155 and a mounting hook 156, 156' connected to each end of the mounting bar 155. In this embodiment, each of the mounting hooks 156, 156' can include downward-projecting finger that is sized to fit within a fixture hole 162, 162'. As such, the mounting bracket 150 can removably attach to the rear support structure 160, 160' by positioning the mounting hooks 156, 156' within the corresponding set of fixture holes 162, 162' such that the mounting bar 155 of the mounting bracket 150 is horizontally positioned, perpendicular to the vertical columns of the rear support structure 160, 160'. In some alternative embodiments, the rear support structure may include a horizontal mounting bar that is fixedly coupled to the vertical columns 160, 160' or the rear wall 161.

As shown in FIG. 6, each of the first and second frame components 170, 180 can be removably mounted on the mounting bar 155 of the mounting bracket 150. In the depicted embodiment, the first frame component 170 includes a set of frame hooks 165, 165' connected at the rearward face of the first frame component 170. Each of the frame hooks 165, 165' of the first frame component 170 can include a downwardly projecting element enabling the first frame component 170 to be removably hooked onto the mounting bar 155 of the mounting bracket 150, for example, at mounting points 167 and 167' without the use of tools. Similarly, the second frame component 180 includes a set of frame hooks 166, 166' connected at the rearward face of the second frame component 180. Each of the frame hooks 166, 166' of the second frame component 180 can include a downwardly projecting element enabling the second frame component 180 to be removably hooked onto the mounting bar 155 of the mounting bracket 150, for example, at mounting points 168 and 168' without the use of tools. The mounting bracket 150 can support both first frame components 170 and 180 in a side-by-side arrangement. Accordingly, in this embodiment, the entire display fixture 100 can be assembled by lifting the first and second frame components 170 and 180 to mate with the mounting bar 155. In such circumstances, the store worker is not necessarily required to install objects above or below the first and second frame components 170 and 180.

While the figures show a single mounting bracket 150 it is envisioned that in many applications a plurality of such mounting brackets will be used to provide stability. For example, two mounting brackets may be used, one near the top of the display and one near the bottom. In such embodiments complimentary frame hooks are provided on the wire frame structures at the appropriate positions so as to couple with the mounting brackets.

Referring now to FIGS. 7-10, in use, some embodiments of the display fixture 100 can be used to contemporaneously present a variety of products (e.g., the posterboard products 125, the foamcore sheet products 135, and the related products 145) within a consumer's line of sight. The products 125, 135, and 145 can, for example, be presented to a consumer at angles to enable a variety of products to be displayed in a compact manner and to provide additional visual interest and appeal to the consumer.

One or more relatively flexible sheet products (e.g., posterboard products 125) can be releasably retained in each of the set of horizontal trays 120 downwardly angled from rear to front. In the depicted embodiment, at least a major surface of one sheet product (e.g., posterboard product 125) in each horizontal tray 120 can be viewable from the front of the display fixture 100. One or more relatively less flexible sheet products (e.g., foamcore sheet products 135) can be releasably retained in each of the set of vertical slots 130 angled sideways in a direction generally away from the horizontal trays 120. In the depicted embodiment, at least a major surface of one sheet product (e.g., foamcore sheet product 135) in each vertical slot 130 can be viewable from the front of the display fixture 100. In some embodiments, different angles of vertical slots 130 included in the upper section 185 and the lower section 190 can provide varying shelf widths and can be used to retain and display sheet products (e.g., foamcore sheet products 135) having different major surface sizes.

In some embodiments, one or more related products 145 (e.g., adhesive products, writing products, stencil products, or the like) usable with the sheet products 125, 135, or both, can be displayed so that the related products 145 are contemporaneously visible with the sheet products 125 and 135. The related products 145 can be releasably retained by one or more hooks 146 labeled by a tag 169. Both the hook 146 and the tag fixture 169 can, for example, be connected to a front-facing wall portion such as the vertically-oriented front-facing wall portion 149 (FIG. 3).

Accordingly, the display fixture 100 can advantageously present sheet products 125 and 135 and related products 145 to consumers, such as retail consumers viewing products in a store aisle. The angled presentation of products in the trays 120 and the slots 130 can allow for a variety of products to be displayed to a consumer in a compact manner that is useful for conserving space in a retail environment. Furthermore, the display fixture 100 provides the ability to cross-merchandise the related products 145 when a consumer is viewing the sheet products 125 and 135. For example, as previously described, the display fixture 100 can facilitate cross-merchandising by receiving one or more hooks 146 attached to the front-facing wall portion 140 to contemporaneously display related products 145 with the sheet products 125 and 135. In some embodiments, the related products 145 can be arranged between at least one tray 120 and at least one slot 130 so that the related products 145 are readily viewed by the consumer while looking toward the sheet products 145.

The sheet products 125, 135, and 145 can, in selected embodiments, from about 300 square inches to about 3600 square inches. In other embodiments, the sheet products can be from about 400 to about 2400 square inches. In still other embodiments, the sheet products are from about 400 to 1600 square inches. In yet other embodiments, the sheet products range from about 300 to about 900 square inches.

In some embodiments, for example, the display fixture 100 can be freestanding from a wall, supported by a base structure. In some embodiments, other planar products including artwork, posters, or calendars can be displayed by the display fixture 100. In some embodiments, the display fixture 100 can present products other than sheet or planar products including media products such as compact discs and digital video discs. In some embodiments, the fixture 100 can be used for purposes other than product display, such as serving as a storage device for a drying process.

The spacing between the horizontal trays (as measured in a direction normal to the major surface of the trays) can range from two to twelve inches or more. In selected embodiments, the distance is between three and ten inches. In still other embodiments the spacing ranges from about three inches to about six inches.

The spacing between the vertical slots frames (measured similarly), can range from two to twelve inches or more. In selected embodiments, the distance is between three and ten inches. In still other embodiments the spacing ranges from about three inches to about six inches.

A number of embodiments of the invention have been described. Nevertheless, it will be understood that various modifications may be made without departing from the spirit and scope of the invention. Accordingly, other embodiments are within the scope of the following claims.

What is claimed is:

1. A product display system comprising:

a rear support structure to receive a display fixture substantially along a vertical plane, the display fixture comprising trays and vertical dividers;

five or more horizontal trays projecting forwardly from the rear support structure and projecting downwardly an angle of about 45° to about 70° relative to a horizontal plane;

three or more first vertical dividers projecting forwardly from the rear support structure and projecting laterally relative to the horizontal trays at a first lateral angle of about 35° to about 60° from the vertical plane;

three or more second vertical dividers projecting forwardly from the rear support structure and projecting laterally relative to the trays at a second lateral angle of about 45° to about 75° from the vertical plane; and at least one front-facing wall portion having a horizontally oriented portion that extends a width of the three or more first vertical dividers and the three or more second vertical dividers and having a vertically oriented portion that extends a height of the three or more second vertical dividers, the at least one front-facing wall portion including a plurality of horizontally oriented bars, wherein the first lateral angle is different from the second lateral angle.

2. The system of claim 1, wherein the display fixture consists essentially of two structural sections, the first structural section comprising the horizontal trays and the second structural section comprising the first and second vertical dividers and the at least one front-facing wall portion.

3. The system of claim 1, wherein the display fixture comprises two structural sections, each of which includes toolless mounting means to releasably secure the sections to a horizontally positioned bar that also includes toolless mounting means to releasably secure the horizontally positioned bar to the rear support structure.

4. The system of claim 1, wherein a first structural section includes between five and fifteen of the horizontal trays and a second structural section includes between three and ten of said first vertical dividers and between three and ten of the second vertical dividers.

5. The system of claim 1, wherein the horizontal trays are generally parallel to one another and at least a plurality of the trays are spaced about three to about six inches apart and wherein the vertical dividers are spaced about three to about six inches apart.

6. The system of claim 1, wherein each first vertical divider projects forwardly from the rear support structure a greater distance than the projection of each second vertical divider from the rear support structure.

7. A display fixture comprising:

a rear support structure;

a mounting bracket removably attached to the rear support structure and including a horizontally positioned bar;

a first frame component including at least one frame hook connected at a rearward face of the first frame component and having a downwardly projecting element to enable the first frame component to be removably hooked onto the horizontally positioned bar without further tooling, the first frame component comprising:

at least one frame member having frame segments located substantially along a vertical plane and a horizontal plane;

a plurality of horizontal trays coupled to the at least one frame member, each of the plurality of horizontal trays being oriented from rear to front at a downward angle relative to the horizontal plane;

a second frame component separable from the first frame component and located adjacent to and lateral of the horizontal trays of the first frame component, the second frame component including at least one frame hook connected at a rearward face of the second frame component and having a downwardly projecting element to enable the second frame component to be removably hooked onto the horizontally positioned bar without further tooling, the second frame component comprising:

a plurality of first vertical slot frames oriented laterally at a first angle relative to the vertical plane; and a plurality of second vertical slot frames arranged adjacent to and below the plurality of first vertical slot frames, arranged adjacent to and lateral of the horizontal trays, and oriented laterally at a second angle relative to the vertical plane, the second angle being different from the first angle.

8. The display fixture of claim 7, wherein the mounting bracket comprises toolless mounting means to releasably secure the horizontally positioned bar to the rear support structure.

9. The display fixture of claim 7, wherein the first angle of the first vertical slot frames is less than the second angle of the second vertical slot frames.

10. The display fixture of claim 7, wherein each first vertical slot frame comprises a front segment oriented from rear to front at a downward angle relative to the horizontal plane.

11. The display fixture of claim 10, wherein the downward angle of the front segment of the first vertical slot frame is greater than the downward angle of the horizontal trays.

* * * * *